US006308495B1

(12) United States Patent
Sambuca, Jr.

(10) Patent No.: US 6,308,495 B1
(45) Date of Patent: Oct. 30, 2001

(54) CASE SEALER BASE LEVELER

(75) Inventor: Anthony J. Sambuca, Jr., Hawley, PA (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 09/414,488

(22) Filed: Oct. 8, 1999

(51) Int. Cl.[7] ..... B65B 61/00

(52) U.S. Cl. ..... 53/136.4; 248/188; 248/188.1; 403/362; 403/374.3

(58) Field of Search ..... 248/188.1, 188, 248/188.5; 108/147.19, 147.21, 144.11; 403/362, 374.3, 377, 378, 379.3; 53/136.4

(56) References Cited

U.S. PATENT DOCUMENTS

| | | | | |
|---|---|---|---|---|
| 3,344,756 | * | 10/1967 | Kelson | 108/106 |
| 3,964,404 | * | 6/1976 | Mueller et al. | 248/188 |
| 4,633,642 | * | 1/1987 | Lissoni | 53/136.4 |
| 5,511,362 | * | 4/1996 | Morita et al. | 53/136.4 |
| 5,687,543 | * | 11/1997 | Lam | 53/136.4 |

* cited by examiner

*Primary Examiner*—Peter Vo
*Assistant Examiner*—Thanh K Truong

(74) *Attorney, Agent, or Firm*—Schwartz & Weinrieb

(57) ABSTRACT

A leveling or elevational positional adjustment system comprises a leg frame member, a leg extension member, and a leg extension stop member. The leg frame member comprises an external corner component having a substantially arcuate configuration, and an internal cross-plate component disposed across the interior of the corner component. The leg extension member has an arcuate cross-sectional configuration essentially matching that of the external corner component of the leg frame member so as to be disposed in surface-to-surface contact with the external corner component of the leg frame member when the leg extension is inserted into the leg frame member, and the leg extension stop member has an external arcuate cross-sectional configuration also substantially matching that of the leg extension member. An actuator screw is mounted upon the cross-plate component of the frame member and is engaged with the leg extension stop member so as to effectively force the leg extension stop member into surface-to-surface contact with the leg extension member such that the leg extension member is in turn forced into surface-to-surface contact with the leg frame member. The leg extension member is positionally adjusted to, and retained at, any particular longitudinal position with respect to the leg frame member simply by untightening the actuator screw, adjusting the disposition of the leg extension member relative to the leg frame member, and retightening the actuator screw.

18 Claims, 6 Drawing Sheets

CASE SEALER BASE LEVELER

FIELD OF THE INVENTION

The present invention relates generally to case, carton, or box sealer machines, equipment, or apparatus, and more particularly to a base leveler mechanism incorporated within such machine, equipment, or apparatus so as to quickly, easily, and readily achieve elevational and leveling adjustments to the base legs of the machine, equipment, or apparatus.

BACKGROUND OF THE INVENTION

In connection with various industrial or commercial machinery, equipment, or apparatus, it is often critically important that the support legs or other similar support structure provided upon the machinery, equipment, or apparatus are properly adjusted with respect to their elevational levels or vertical dispositions so as not only to properly support the apparatus, machinery, or equipment at the desired elevation or orientation, but in addition, to ensure that the support legs or support structure together define a support arrangement for the machinery, apparatus, or equipment which renders the machinery, apparatus, or equipment truly level. In this manner, proper operation of the machinery, equipment, or apparatus components, without such components encountering operational problems due to the non-level disposition of the machinery, equipment, or apparatus, is ensured.

One known type of vertical adjustment or leveling system comprises the use of, for example, a leg extension which is adapted to be adjustably affixed to a frame member of the machine, equipment, or apparatus. In particular, one of the leg extension or frame member components is provided with a single aperture, and the other one of the leg extension or frame member components is provided with an array or plurality of vertically spaced apertures. A bolt or other suitable fastener is then adapted to be inserted into or extend through the single aperture defined within either the leg extension or the frame member, as well as to be inserted into or extend through a selected one of the plurality of apertures defined within the other one of the leg extension or frame member components so as to affix the leg extension at a particular vertical position with respect to the frame member. The operative disadvantage of such a system, however, is at least twofold.

Firstly, in order to perform a height adjustment of the leg extension, the components of the support system must in effect be disassembled. More particularly, the bolt or other suitable fastener must firstly be removed, the leg extension is then able to be moved or repositioned with respect to the frame member of the machine, equipment, or apparatus, and subsequently, when the leg extension is disposed at the new desired location with respect to the frame member, the bolt or other fastener must then be reinserted into the aligned apertures of the leg extension and the frame member components and retightened so as to in fact securely affix the leg extension and frame member components together. Secondly, in view of the fact that one of the components is provided with the array or plurality of separate, vertically spaced apertures, when the repositioned bolt or other similar fastener is reinserted or repositioned within a particular one of such vertically spaced apertures, it is to be appreciated that the leg extension is not able to be repositioned or relocated with respect to the frame member at any desirable elevational level but, in effect, can only be elevationaly repositioned or adjusted with respect to the frame member in a precisely defined incremental manner as dictated by means of the array of vertically spaced apertures.

Accordingly, a need exists in the machinery, apparatus, or equipment art for a base leveling or leg adjustment system which can readily, easily, and quickly permit leg extension members, of such various machinery, equipment, or apparatus to be repositioned or elevationally adjusted in, in effect, a continuous, infinite manner such that precise leveling or elevational adjustment of such leg extension or leveling systems can in fact be readily, easily, and quickly achieved whereby the machinery, equipment, or apparatus can be properly or truly leveled or oriented as a result of which proper operation of the various operational components of the machinery, apparatus, or equipment will be ensured.

OBJECTS OF THE INVENTION

Accordingly, it is an object of the present invention to provide a new and improved leveling or elevational positional adjustment system.

Another object of the present invention is to provide a new and improved leveling or elevational positional adjustment system for use in connection with various machinery, equipment, or apparatus, and particularly in connection with case sealers.

An additional object of the present invention is to provide a new and improved leveling or elevational positional adjustment system for use in connection with various machinery, equipment, or apparatus, and particularly in connection with case sealers, which effectively overcomes the various operational drawbacks or disadvantages characteristic of the known PRIOR ART.

A further object of the present invention is to provide a new and improved leveling or elevational positional adjustment system for use in connection with various machinery, equipment, or apparatus, and particularly in connection with case sealers, which effectively overcomes the various operational drawbacks or disadvantages characteristic of the known PRIOR ART in that the leg extension adjustment and leveling operations can be readily, quickly, and easily performed without requiring any disassembly of the relative component parts of the machinery, equipment, or apparatus base or support system, and wherein further, substantially continuous infinitesimal adjustment of the elevational disposition of the leg extension components relative to the machinery, equipment, or apparatus frame member can be achieved.

SUMMARY OF THE INVENTION

The foregoing and other objectives are achieved in accordance with the principles and teachings of the present invention through the provision of a new and improved leveling or elevational positional adjustment system for use in connection with various machinery, equipment, or apparatus, and particularly in connection with case sealers, wherein such leveling or elevational positional adjustment system comprises essentially a frame leg member, an extension leg member, and an extension leg stop member. The frame leg member comprises an external corner component having a substantially arcuate configuration, and an internal cross-plate component disposed across the interior of the corner component so as to effectively define an interior space having a substantially triangular configuration. The extension leg member has an arcuate cross-sectional configuration essentially matching that of the external corner component of the frame leg member so as to be disposed in surface-to-surface contact with the external corner component of the frame leg member when the extension leg member is inserted into the frame leg member, and the extension leg stop member has an external arcuate cross-sectional configuration also substantially matching that of the extension leg member.

An actuator screw is mounted upon the cross-plate component of the frame leg member and is engaged with the extension leg stop member so as to effectively force the extension leg stop member into surface-to-surface contact with the extension leg member such that the extension leg member is in turn forced into surface-to-surface contact with the frame leg member. In this manner, the extension leg member is positionally adjusted to, and retained at, any particular longitudinal position with respect to the frame leg member simply by untightening the actuator screw, adjusting the disposition of the extension leg member relative to the frame leg member, and retightening the actuator screw so as to secure the extension leg member at its new position with respect to the frame leg member.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
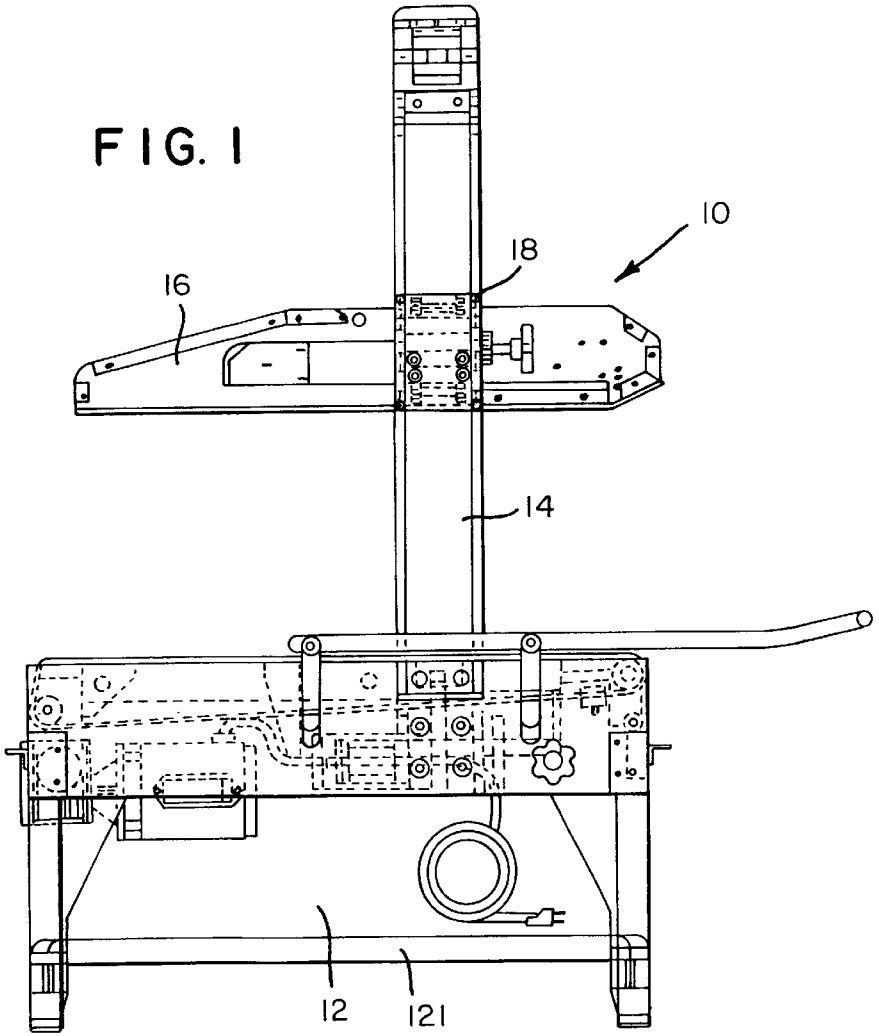
FIG. 1 is a front elevational view, partly in cross-section, of a case sealer machine in connection with which the new and improved base leveling or elevational positional adjustment system, constructed in accordance with the principles and teachings of the present invention, may be employed.

Referring now to the drawings, and more particularly to FIG. 1 thereof, a case sealer machine, in connection with which the new and improved base leveling or elevational positional adjustment system, which has been constructed in accordance with the principles and teachings of the present invention as will be described more fully hereinafter, may be employed, is disclosed and is generally indicated by the reference character 10. In view of the fact that the various operative components of the case sealer machine 10, other than the new and improved base leveling or elevational positional adjustment system, are not actually part of the present invention, only a brief description of the case sealer machine 10 per se will be described, and such description will then be followed by a detailed description of the new and improved base leveling or elevational positional adjustment system comprising the present invention. Accordingly, it is to be appreciated that the case sealer machine 10 comprises a base frame assembly 12 which of course serves to support the machine upon a production facility floor or other platform. A vertically upstanding mast 14 is fixedly secured at its lower end to a rear portion of the base frame assembly 12 best seen in FIG. 2 such that the mast 14 projects upwardly from the base frame assembly 12, and a head assembly 16 is adapted to be adjustably mounted upon the mast 14 by means of a slidable trolley assembly 18. The head assembly 16 serves to mount a tape cartridge, not shown, for use in taping or sealing cases, cartons, boxes, and the like, which are adapted to be sealed by means of the case sealer machine 10.

Figure 5:
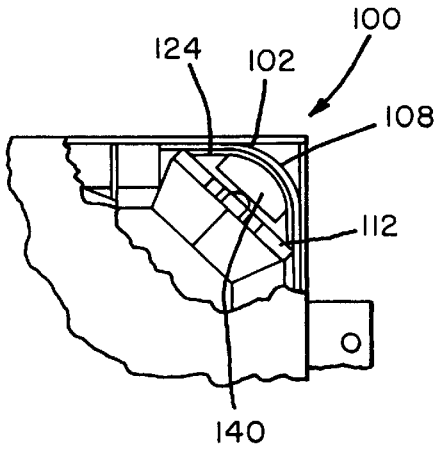
FIG. 5 is an enlarged view of the circled corner region A of FIG. 4.
Figure 6:
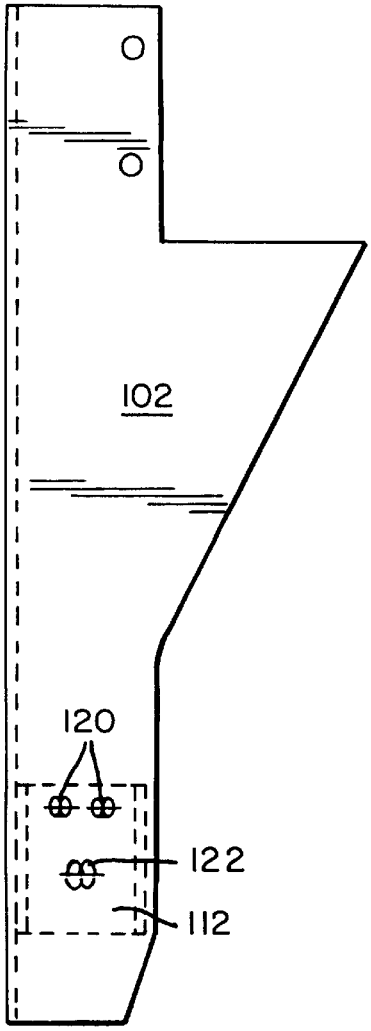
FIG. 6 is a side elevational view of one of the frame leg members utilized within the base leveling or elevational positional adjustment system constructed in accordance with the principles and teachings of the present invention and employed upon the case sealer machine disclosed within FIG. 1.

As has been noted hereinbefore, in order for the case sealer machine 10 to operate properly, such that, for example, the head assembly 16 can smoothly and readily be adjustably positioned upon the mast 14 by means of the trolley assembly 18 without experiencing, for example, any binding or jamming problems or difficulties, it is imperative that the machine 10 be properly leveled. Accordingly, such leveling operation is readily, easily, and quickly achieved in accordance with the base leveling or elevational positional adjustment system which has been constructed in accordance with the principles and teachings of the present invention and which is generally indicated by the reference character 100 as best seen in FIG. 5.

Figure 7:
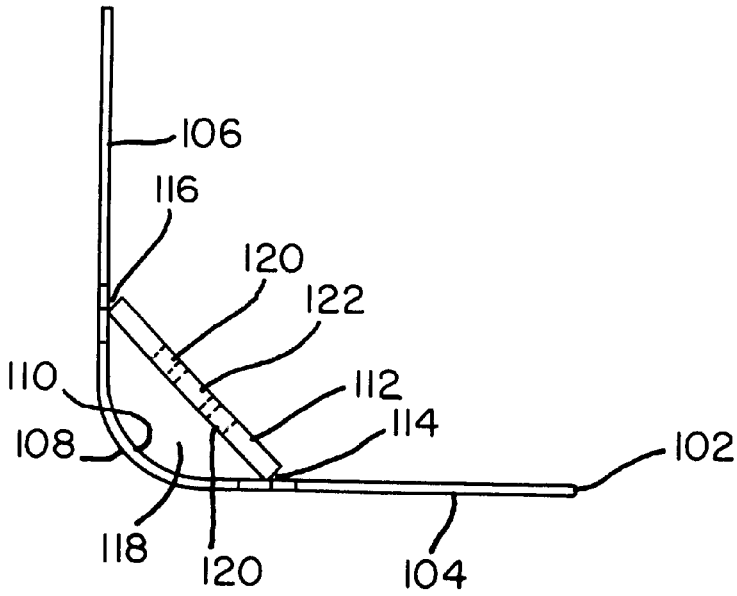
FIG. 7 is a top plan view of the frame leg member shown in FIG. 6.

As can be appreciated from FIGS. 3 and 5–7, the base frame assembly 12 comprises a plurality of upstanding supporting frame leg members 102 which are respectively disposed at the four corners of the base frame assembly 12. Each one of the frame leg members 102 has a substantially L-shaped horizontal cross-sectional configuration, as best seen in FIG. 7, wherein divergent sides of each frame leg member 102 are noted at 104,106 and wherein further the sides 104,106 of each frame leg member 102 are disposed substantially perpendicular to each other. The sides 104,106 of each frame leg member 102 are also integrally interconnected together by means of an arcuate or radiused corner portion 108 which therefore defines a substantially arcuate corner region 110.

Figure 2:
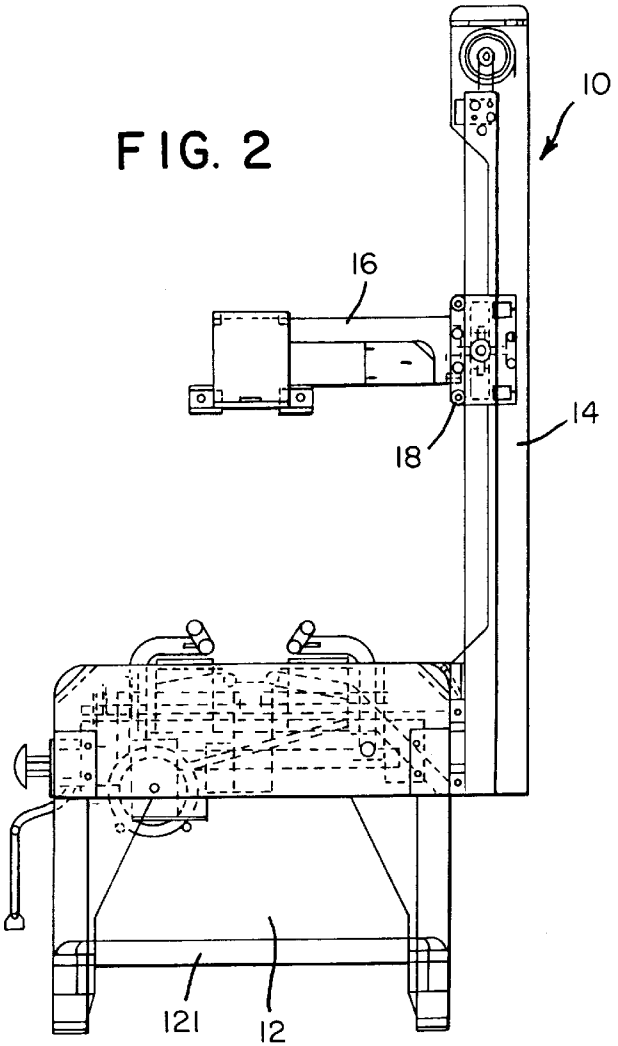
FIG. 2 is a side elevational view, partly in cross-section, of the case sealer machine disclosed within FIG. 1.
Figure 3:
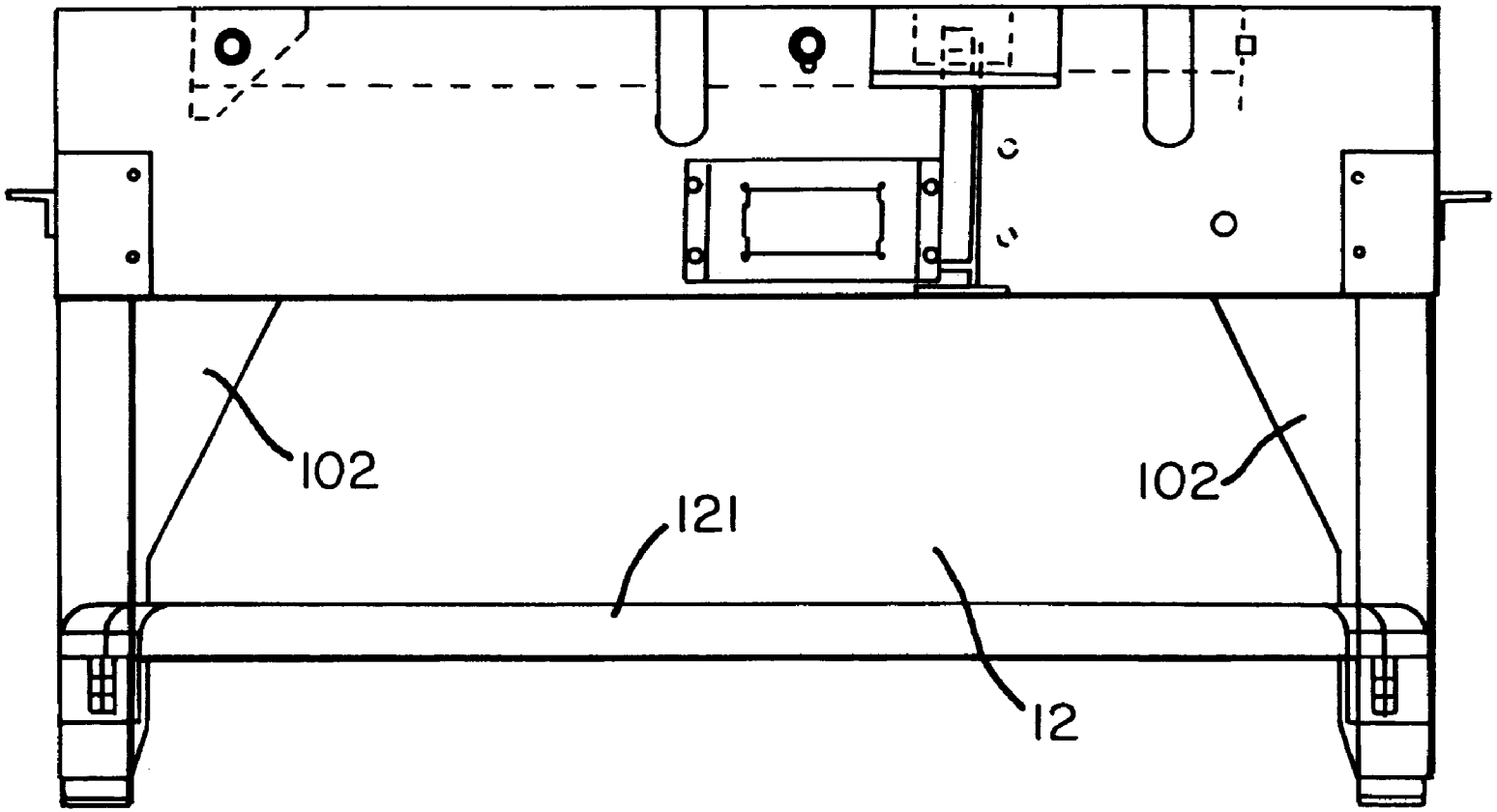
FIG. 3 is a front elevational view, partly in cross-section, of the base frame assembly utilized within the case sealer machine disclosed within FIGS. 1 and 2.
Figure 4:
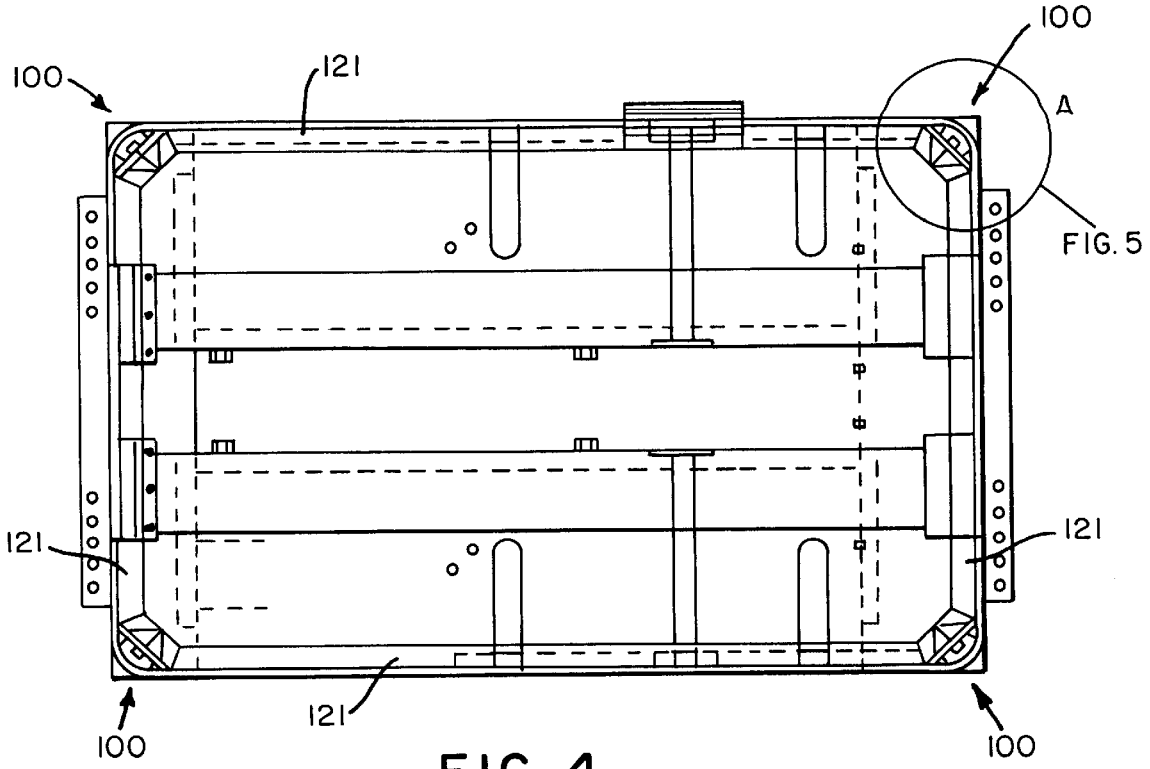
FIG. 4 is a top plan view of the base frame assembly shown within FIG. 3.

In addition to the aforenoted structure comprising each frame leg member 102, each frame leg member 102 also comprises a support plate member 112 which has opposite side portions thereof affixed to each one of the sides 104,106 of the frame leg member 102, such as, for example, by weld regions 114,116 or the like, such that the plate member 112 extends transversely across the corner region 110 of the frame leg member 102. As a result of the fixation of the plate member 112 across the corner region 110 of the frame leg member 102, and in particular, as a result of the fixation of the plate member 112 to each one of the sides 104, 106 of the frame leg member 102, a channel 118 having a substantially triangular configuration in horizontal cross-section is defined between the plate member 112 and the corner portion 108 of the frame leg member 102. It is further noted that the plate member 112 is symmetrically disposed across the corner region 110 of the frame leg member 102, that is, a line perpendicular to the plate member 112 as seen in FIGURE 7 is aligned with the radius of the arcuate or radiused portion 108 which bisects the right angle defined between the side members 104,106 of the frame leg member 102. Still yet further, each plate member 112 has a pair of apertures 120,120 defined therein for receiving bolt members or other similar fasteners, not shown, which serve to attach horizontally disposed brace members 121 between frame leg members 102 as seen in FIG. 1–3, and a third, internally threaded aperture 122 for a purpose to be described hereinafter.

Figure 11:
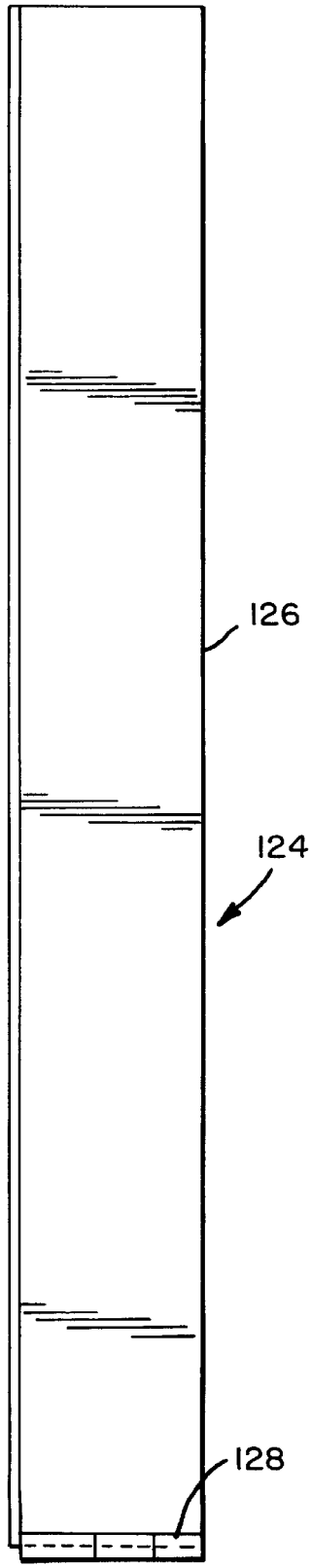
FIG. 11 is a side elevational view of the extension leg member utilized within the base leveling or elevational positional adjustment system constructed in accordance with the principles and teachings of the present invention and employed upon the case sealer machine disclosed within FIG. 1.
Figure 12:
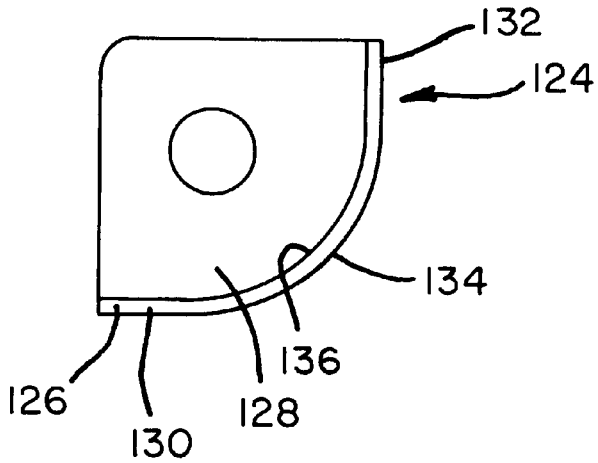
FIG. 12 is a top plan view of the extension leg member disclosed within FIG. 11.

Turning now to FIGS. 11 and 12, an extension leg member of the base leveling or elevational positional adjustment system 100 of the present invention is disclosed therein and is generally indicated by the reference character 124. It is to be understood that in accordance with the principles and teachings of the present invention, an extension leg member 124 is adapted to be used in conjunction with each one of the plurality of frame leg members 102 so as to effectively provide an extended length dimension to each one of the frame leg members 102 as may prove necessary in order to achieve proper elevational adjustments of, and leveling operations upon, the machine, equipment, or apparatus 10.

Each extension leg member 124 is seen to comprise a vertically extending extension leg component 126, and a horizontally disposed lower plate component 128 integrally secured to the lower end portion of the extension leg component 126. As was the case with each frame leg member 102, each one of the extension leg components 126 has a substantially L-shaped horizontal cross-sectional configuration as best seen in FIG. 12 wherein the sides of each extension leg component 126 are noted at 130,132 and wherein further the sides 130,132 of each extension leg component 126 are disposed substantially perpendicular to each other. The sides 130,132 of each extension leg component 126 are also integrally interconnected together by means of an arcuate or radiused corner portion 134 which therefore defines a substantially arcuate corner region 136. It is also noted that the radiused dimension of the arcuate or radiused portion 134 is substantially the same as that of arcuate or radiused portion 108 of the frame leg member 102 such that each extension leg member 124 can properly mate with each frame leg member 102 in a surface-to-surface manner as will be more fully disclosed hereinafter. Still further, it is noted that the lower plate component 128 is provided with an aperture 138 which is located at a substantially central portion thereof. The aperture 138 is adapted to receive a bolt or other suitable fastener, not shown, by means of which each extension leg member 124, and therefore the machine, equipment, or apparatus 10, is able to be fixedly connected to a production or manufacturing plant facility floor, support platform, or the like.

Figure 8:
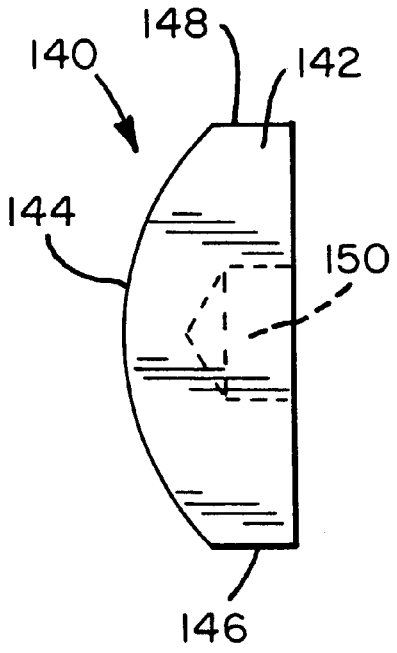
FIG. 8 is a front elevational view of the extension leg stop member utilized within the base leveling or elevational positional adjustment system constructed in accordance with the principles and teachings of the present invention and employed upon the case sealer machine disclosed within FIG. 1.
Figure 9:
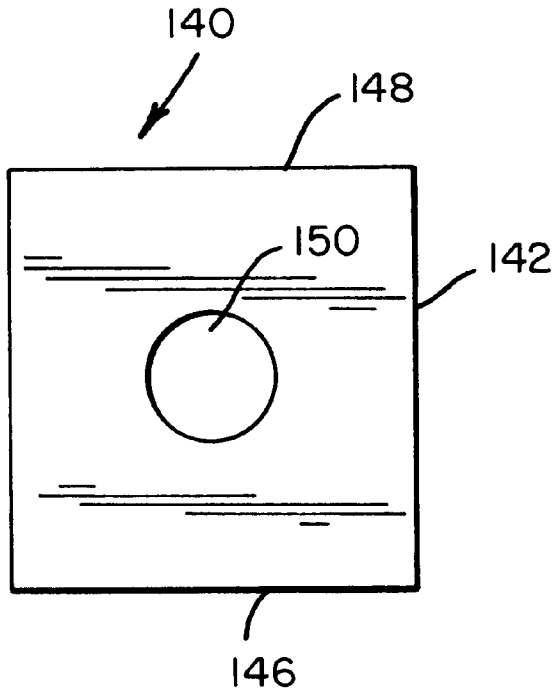
FIG. 9 is a side elevational view of the extension leg stop member shown within FIG. 8.
Figure 10:
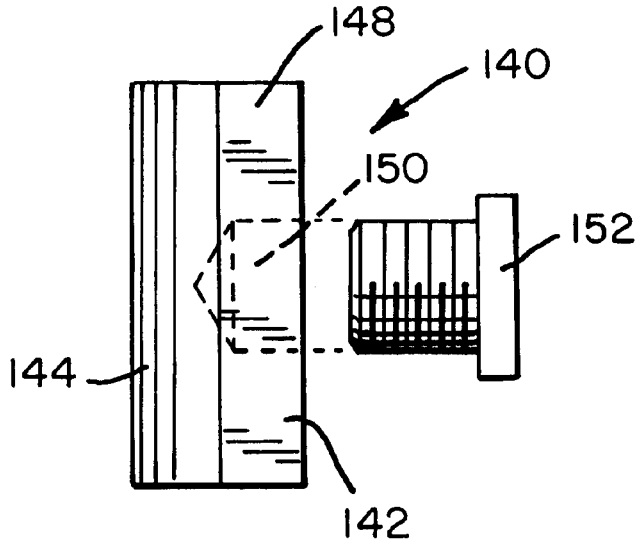
FIG. 10 is a top plan view of the extension leg stop member disclosed within FIG. 8.

With reference lastly being made to FIGS. 8–10, an extension leg stop member is disclosed and is generally indicated by the reference character 140. The extension leg stop member 140 has a substantially square-shaped base portion 142 and a domed upper portion 144 which extends from the front side 146 of the stop member 140 to the rear side 148 of the stop member. The domed upper portion 144 of the extension leg stop member 140 has a radiused curvature which is substantially similar to the curvature of the radiused corner portion 108 of the frame leg member 102 as well as the curvature of the radiused corner portion 134 of the extension leg member 124. In this manner, as will be more fully appreciated hereinafter, when an extension leg stop member 140 is mounted upon each one of the frame leg members 102, and more particularly, when an extension leg stop member 140 is mounted upon each one of the transversely disposed cross-plate members 112 of the frame leg members 102, the domed upper portion 144 of the extension leg stop member 140 will be disposed in surface-to-surface contact with the interior surface portion of the radiused corner portion 134 of the extension leg member 124.

With reference continuing to be made to FIGS. 8–10, it is seen that the extension leg stop member 140 further comprises a blind bore 150 formed within the base portion 142 of the extension leg stop member 140. This blind bore 150 is adapted to receive the tip portion of a screw fastener or other actuating pin or bolt 152 which is adapted to be threadedly mounted within the aperture 122 of each transversely disposed cross-plate member 112 of each frame leg member 102 such that as the screw fastener, pin, or bolt 152 is threadedly engaged within the transversely disposed cross-plate member 112 of each frame leg member 102, the extension leg stop member 140 will be forced into surface-to-surface engagement with the interior surface portion of the radiused corner portion 134 of the extension leg member 124. The substantially square-shaped configuration of the base portion 142 of the extension leg stop member 140 serves to prevent rotation of the extension leg stop member 140 relative to the interior surface portion of the radiused corner portion 134 of the extension leg member 124 as may be best appreciated from FIG. 5.

In light of the foregoing description, the operation of the height adjustment and leveling system 100 of the present invention is submitted to be clear. A vertically extending extension leg component 126 of each extension leg member 124 is inserted into each one of the frame leg members 102 such that the radiused corner portion 134 of each extension leg component 126 is disposed in surface-to-surface contact with the radiused corner portion 108 of each frame leg member 102, and in addition, it is to be appreciated that each extension leg component 126 will be disposed within the channel region 118 defined within each frame leg member 102. In addition, the extension leg stop member 140 will likewise be disposed within the channel region 118 defined within each frame leg member 102, and the extension leg stop member 140 will be retained within such channel region 118 of each frame leg member 102 as a result of the disposition of the tip portion of the threaded fastener 152 within the blind bore 150 of the extension leg stop member 140.

Consequently, when each threaded fastener 152 is threadedly engaged or manipulated in accordance with an extended threading operation with respect to the transversely disposed cross-plate member 112 of each frame leg member 102, the threaded fastener 152 will force the extension leg stop member 140 to serve as an actuator and effectively be translated in a jacking type mode against the interior radiused surface portion 136 of each extension leg member 124 whereby the radiused corner portion 134 of the extension leg stop member 124 will in turn will be actuated or forced into contact with the interior radiused surface portion 110 of each frame leg member 102 such that each extension leg member 124 is fixedly retained at a particular longitudinal position with respect to its corresponding frame leg member 102. An elevational adjustment or leveling operation will now accordingly be briefly described.

When the position of a particular one of the extension leg members 124 is desired to be changed with respect to its corresponding frame leg member 102, the threaded fastener 152 is threadedly manipulated in a retracted sense, the forced surface-to-surface contact defined between the radiused corner portion 134 of the extension leg stop member 124 and the interior radiused surface portion 110 of the frame leg member 102 is relieved, and therefore, the extension leg member 124 is able to be longitudinally moved with respect to its corresponding frame leg member 102. When the extension leg member 124 and the frame leg member 102 are disposed at a newly desired relative position, the threaded fastener 152 is again threadedly manipulated in the extension mode such that the extension leg stop member 140 is again forced into contact with the interior radiused surface portion 136 of the extension leg member 124, and similarly, the radiused corner portion 134 of the extension leg member 124 is forced into contact with the interior radiused surface portion 110 of the frame leg member 102 so as to fixedly retain the frame leg member 102 and the extension leg member 124 at their new positions with respect to each other.

Thus, it may be seen that in accordance with the principles and teachings of the present invention, a new and improved elevational or leveling system for machinery, apparatus, or equipment has been developed which will readily, easily, and quickly permit leveling adjustments to be made without the need for disassembling any component parts of the machinery, equipment, or apparatus leg support system. In addition, since there are no distinct apertures defined within the frame leg and extension leg members, and wherein the longitudinal fixation of the extension leg member is achieved with respect to the frame leg member simply by surface-to-surface frictional forces developed by means of the jacking system as disclosed hereinbefore, height or leveling adjustments may be made to the system in a substantially infinite manner as opposed to discrete steps or increments characteristic of the PRIOR ART.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. A system for adjusting the relative longitudinal disposition of a first member with respect to a second member, comprising:

a first member having a first surface portion;

a second member having a substantially smooth second surface portion which is adapted to be forcefully disposed into surface-to-surface contact with said first surface portion of said first member such that said second member can be retained at any one of a substantially unlimited number of particular longitudinal positions with respect to said first member;

a stop member; and adjustable engagement means mounted upon said first member for providing adjustable engagement with respect to said stop member such that when said adjustable engagement means is adjustably manipulated with respect to said first member, said adjustable engagement means will be forced into engagement with said stop member such that said stop member will force said second surface portion of said second member into engagement with said first surface portion of said first member so as to retain said second member at said any one of said substantially unlimited number of particular longitudinal positions with respect to said first member.

2. The system as set forth in claim 1, wherein said means for providing said adjustable engagement comprises:

a support plate mounted upon said first member; and an actuator mounted upon said support plate and translationally movable into contact with said second member so as to force said second surface portion of said second member into engagement with said first surface portion of said first member.

3. The system as set forth in claim 2, wherein:

said first member has a pair of divergently extending side portions defining a corner portion therebetween;

said second member has a pair of divergently extending side portions defining a corner portion therebetween; and said support plate is mounted upon said divergently extending side portions of said first member and extends across said corner portion of said first member so as to define a channel portion with said corner portion of said first member within which said corner portion of said second member and said actuator are disposed.

4. The system as set forth in claim 3, wherein:

said corner portion of said first member has an arcuate, radiused configuration;

said corner portion of said second member has an arcuate, radiused configuration substantially similar to said arcuate, radiused configuration of said corner portion of said first member; and said actuator has an arcuate, radiused configuration similar to said arcuate, radiused configurations of said first and second members.

5. The system as set forth in claim 2, wherein:

said support plate has a threaded aperture defined therein; and a threaded fastener is threadedly disposed within said threaded aperture of said support plate and is engaged with said actuator such that upon threaded movement of said threaded fastener with respect to said support plate, said threaded fastener forces said actuator into contact with said second member.

6. A leveling system for adjusting the relative longitudinal disposition of an extension leg member with respect to a frame leg member of a machine, comprising:

a frame leg member having a first surface portion;

an extension leg member having a substantially smooth second surface portion which is adapted to be forcefully disposed into surface-to-surface contact with said first surface portion of said frame leg member so as to retain said extension leg member at any one of a substantially unlimited number of particular longitudinal positions with respect to said frame leg member;

a stop member; and adjustable engagement means mounted upon said frame leg member for providing adjustable engagement with respect to said stop member such that when said adjustable engagement means is adjustably manipulated with respect to said frame member, said adjustable engagement means will be forced into engagement with said stop member such that said stop member will force said second surface portion of said extension leg member into engagement with said first surface portion of said frame leg member so as to retain said extension leg member at said any one of said substantially unlimited number of particular longitudinal positions with respect to said frame leg member such that proper leveling of the machine can be achieved.

7. The leveling system as set forth in claim 6, wherein said means for providing said adjustable engagement comprises:

a support plate mounted upon said frame member; and an actuator mounted upon said support plate and translationally movable into contact with said extension leg member so as to force said second surface portion of said extension leg member into engagement with said first surface portion of said frame member.

8. The leveling system as set forth in claim 7, wherein:

said frame member has a pair of divergently extending side portions defining a corner portion therebetween;

said extension leg member has a pair of divergently extending side portions defining a corner portion therebetween; and said support plate is mounted upon said divergently extending side portions of said frame member and extends across said corner portion of said frame member so as to define a channel portion with said corner portion of said frame member within which said corner portion of said extension leg member and said actuator are disposed.

9. The leveling system as set forth in claim 8, wherein:

said corner portion of said frame member has an arcuate, radiused configuration;

said corner portion of said extension leg member has an arcuate, radiused configuration substantially similar to said arcuate, radiused configuration of said corner portion of said frame member; and said actuator has an arcuate, radiused configuration similar to said arcuate, radiused configurations of said frame and extension leg members.

10. The leveling system as set forth in claim 7, wherein:

said support plate has a threaded aperture defined therein; and a threaded fastener is threadedly disposed within said threaded aperture of said support plate and is engaged with said actuator such that upon threaded movement of said threaded fastener with respect to said support plate, said threaded fastener forces said actuator into contact with said extension leg member.

11. In combination with a machine, a leveling system for adjusting the relative longitudinal disposition of an extension leg member with respect to a frame leg member of said machine, comprising:

a base frame assembly;

a frame leg member mounted upon said base frame assembly and having a first surface portion;

an extension leg member having a substantially smooth second surface portion which is adapted to be forcefully disposed into surface-to-surface contact with said first surface portion of said frame leg member so as to retain said extension leg member at any one of a substantially unlimited number of particular longitudinal positions with respect to said frame leg member;

a stop member; and adjustable engagement means mounted upon said frame leg member for providing adjustable engagement with respect to said stop member such that when said adjustable engagement means is adjustably manipulated with respect to said frame member, said adjustable engagement means will be forced into engagement with said stop member such that said stop member will force said second surface portion of said extension leg member into engagement with said first surface portion of said frame leg member so as to retain said extension leg member at said any one of said substantially unlimited number of particular longitudinal positions with respect to said frame leg member such that proper leveling of said machine can be achieved.

12. The combination as set forth in claim 11, wherein said means for providing said adjustable engagement comprises:

a support plate mounted upon said frame member; and an actuator mounted upon said support plate and translationally movable into contact with said extension leg member so as to force said second surface portion of said extension leg member into engagement with said first surface portion of said frame member.

13. The combination as set forth in claim 12, wherein:

said frame member has a pair of divergently extending side portions defining a corner portion therebetween;

said extension leg member has a pair of divergent ly extending side portions defining a corner portion therebetween; and said support plate is mounted upon said divergently extending side portions of said frame member and extends across said corner portion of said frame member so as to define a channel portion with said corner portion of said frame member within which said corner portion of said extension leg member and said actuator are disposed.

14. The combination as set forth in claim 13, wherein:

said corner portion of said frame member has an arcuate, radiused configuration;

said corner portion of said extension leg member has an arcuate, radiused configuration substantially similar to said arcuate, radiused configuration of said corner portion of said frame member; and said actuator has an arcuate, radiused configuration similar to said arcuate, radiused configurations of said frame and extension leg members.

15. The combination as set forth in claim 12, wherein:

said support plate has a threaded aperture defined therein; and a threaded fastener is threadedly disposed within said threaded aperture of said support plate and is engaged with said actuator such that upon threaded movement of said threaded fastener with respect to said support plate, said threaded fastener forces said actuator into contact with said extension leg member.

16. The combination as set forth in claim 11, wherein:

said machine comprises a case sealer machine.

17. The combination as set forth in claim 16, wherein said case sealer machine comprises:

a mast fixedly mounted upon said base frame assembly; and a head assembly slidably disposable upon said mast for carrying a case sealing mechanism.

18. The combination as set forth in claim 11, wherein:

said base frame assembly a plurality of frame leg members respectively disposed at corner regions of said base frame assembly; and a plurality of extension leg members and a plurality of said adjustable engagement means are respectively operatively associated with said plurality of frame leg members so as to permit individual leveling of respective ones of said extension leg members with respect to respective ones of said frame leg members at respective ones of said corner regions of said base frame assembly of said machine.

* * * * *